United States Patent [19]

Kokido

[11] 4,446,677

[45] May 8, 1984

[54] PACKING APPARATUS FOR A SQUEEZED PACKAGE

[76] Inventor: Toshiyuki Kokido, 1087-1, Oaza Mikekado, City of Buzen, Fukuoka Prefecture, Japan

[21] Appl. No.: 312,840

[22] Filed: Oct. 19, 1981

[30] Foreign Application Priority Data

Jan. 28, 1981 [JP] Japan ..... 56-12172

[51] Int. Cl.[3] ..... B65B 93/42; B65B 51/06

[52] U.S. Cl. ..... 53/577; 53/576; 53/583; 53/552

[58] Field of Search ..... 53/138 A, 378, 552, 53/567, 577, 583, 226, 576

[56] References Cited

U.S. PATENT DOCUMENTS

| | | | |
|---|---|---|---|
| 2,513,459 | 7/1950 | Dodge | 53/577 X |
| 2,656,658 | 10/1953 | Grady | 53/577 |
| 2,757,499 | 8/1956 | Albrecht | 53/226 |
| 3,401,499 | 9/1968 | Albrecht | 53/138 A |
| 3,729,896 | 5/1973 | Lehmann | 53/583 |
| 4,242,171 | 12/1980 | Kaucz | 53/583 X |

FOREIGN PATENT DOCUMENTS

| | | | |
|---|---|---|---|
| 2307354 | 8/1974 | Fed. Rep. of Germany | 53/552 |
| 1438022 | 6/1976 | United Kingdom | 53/583 |
| 1564397 | 4/1980 | United Kingdom | 53/138 A |

*Primary Examiner*—John Sipos

*Attorney, Agent, or Firm*—LeBlanc, Nolan, Shur & Nies

[57] ABSTRACT

A packing apparatus, in particular for provisions in a squeezed style package, is provided comprising a hopper to supply a predetermined amount of the provisions into a synthetic resin film tube, a heat-seal and fusion cutting device disposed beneath the hopper to heat seal and cut the tube, a squeezing device disposed beneath the heat-seal and cutting device comprising two pairs of horizontal parallel bars disposed at right angles such that the confronting bars of each of the pairs are adapted to be moved towards and away from each other, a taping device disposed near the squeezing device and adapted to tape around the squeezed portion of the packing with an adhesive tape, a cutting device to sever the adhesive tape after taping, and a driving means to actuate the various components in a synthronized manner.

2 Claims, 8 Drawing Figures

PACKING APPARATUS FOR A SQUEEZED PACKAGE

BACKGROUND OF THE INVENTION

The present invention relates to a packing apparatus, and more particularly to a packing apparatus for producing a squeezed package for provisions.

It has been a common practice to pack provisions in a synthetic resin film tube with a sealed bottom in such a manner that after the tube is filled with the provisions it is heat sealed at the open top portion above the level of the contents. Therefore, a package having straight heat-sealed lines at the top and bottom portions of the tube is obtainable so that a package having generally a rectangular appearance is provided. However, a package having such an appearance is not attractive to general purchasers.

In order to remedy such a defect in conventional packages, it has become known to pack provisions in synthetic resin film tubes in a so-called squeezed packing style having generally a round configuration without any straight line portions. Thus, the packages present an attractive appearance to the purchasers. However, since in such squeezed packing the formation of the squeezed portion and the winding of an adhesive tape around it using a taping device have both been required to be carried out manually, the productivity of the packing is necessarily low. Therefore, it has been desired in the field of the art to develop an apparatus which enables the formation of the squeezed portion and the winding of the adhesive tape therearound to be automatically carried out.

SUMMARY OF THE INVENTION

It is a primary object of the present invention to provide a packing apparatus, particularly for packaging provisions in a squeezed package style, which allows automatic formation of the squeezed package portion and winding of an adhesive tape therearound.

It is other object of the present invention to provide a packing apparatus for packaging provisions in a squeezed package style which can form the squeezed portion in the finest appearance together with the wound adhesive tape.

It is a further object of the present invention to provide a packing apparatus for packaging provisions in a squeezed package style which is suitable for producing squeezed packages in large quantities.

In accordance with the present invention, a packing apparatus, particularly for packaging provisions in a squeezed style, is provided which comprises a hopper arranged at the top of the apparatus frame for supplying provisions to be packed into a synthetic resin film tube with a sealed bottom, a heat seal and fusion cutting means arranged beneath the hopper for heat sealing and cutting the tube which comprises a stationary member secured to the frame and a reciprocating member arranged horizontally opposite thereto, the members being provided with a heat sealer and a fusion cutter, respectively, a squeezing device arranged beneath the heat seal and fusion cutting means comprising two pairs of horizontal parallel bars, the pairs being disposed at right angles to each other and the bars of the respective pairs being adapted to be moved towards and away from each other in a synchronized manner, and a taping device arranged so as to cooperate with one of the pairs of parallel bars to effect winding an adhesive tape around the squeezed portion formed by the squeezing device.

According to one aspect of the present invention, the heat seal and fusion cutting means and one of the pairs of parallel rods are all activated by a common driving shaft through links and a set of cams secured to the common drive shaft so as to cooperate with the links in a timed relationship.

According to an other aspect of the present invention the other pair of parallel rods is adapted to be activated by wire and pully devices driven through the one pair of parallel rods.

According to a further aspect of the present invention, the taping device is pivotally mounted to one of the parallel bars of the one pair and comprises a base frame with an arcuate passage for the adhesive tape, a pressor provided at the entrance portion of the arcuate passage, a gear also arranged at the entrance opposite the pressor, and a tape supply rotatively mounted to the base frame, whereby the base frame is adapted to be swing towards the squeezed portion of the package in association with the movement of the pairs of parallel rods.

BRIEF DESCRIPTION OF THE DRAWINGS

These and other objects of the present invention will become more readily apparent upon reading the following specification and upon reference to the accompanying drawings, in which.

DESCRIPTION OF THE PREFERRED EMBODIMENT

Figure 1:
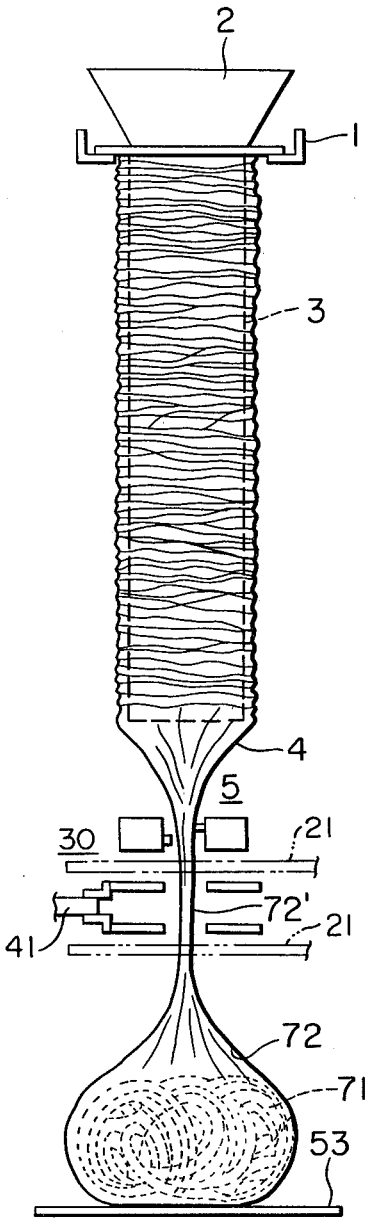
FIG. 1 is a schematical view showing the principle of the present invention.

Reference is now made to FIG. 1 of the attached drawings wherein is shown schematically the principle of the squeeze-packing apparatus according to the present invention. As shown in FIG. 1, a hopper 2 mounted on the apparatus frame 1 at its top portion has a vertical hollow elongated cylinder 3 integrally secured thereto at its lower end. Arranged in order below the lower open end of cylinder 3 are a heat seal and fusion cutting device 5 for heat sealing and cutting a synthetic resin film tube 4 and a squeeze mechanism 30 with predetermined gaps being left therebetween. Furthermore, disposed directly below squeeze mechanism 30 with a predetermined vertical distance being left therebetween is a squeezed packing support plate 53.

In brief, in operation, in the state of heat-seal and fusion cutting device 5 and squeeze mechanism 30 being open synthetic resin film tube 4 with its lower end previously heat-sealed is sheathed in a bellows-like fashion on the outer periphery of hollow cylinder 3 from the underside till the open upper end of tube 4 reaches the vicinity of the lower end of hopper 2, a predetermined amount of the provisions 71 to be packed is supplied to hopper 2 by gravity to be introduced into tube 4 through hollow cylinder 3. In this state, heat-seal and fusion cutting device 5 is operated to heat-seal tube 4 above the upper level of provisions 71 and simultaneously squeeze mechanism 30 is operated to squeeze tube 4 at a position below the heat-sealed portion. After this operation, tube 4 is severed by heat-seal and fusion cutting device 5 at a location above the heat-sealed portion so that the squeeze-package 72 having a squeezed portion 72' thus formed is dropped on squeeze-packing support plate 53 disposed below squeeze mechanism 30.

Next the constitution of the apparatus will be fully explained in reference to FIGS. 2 to 8.

Figure 2:
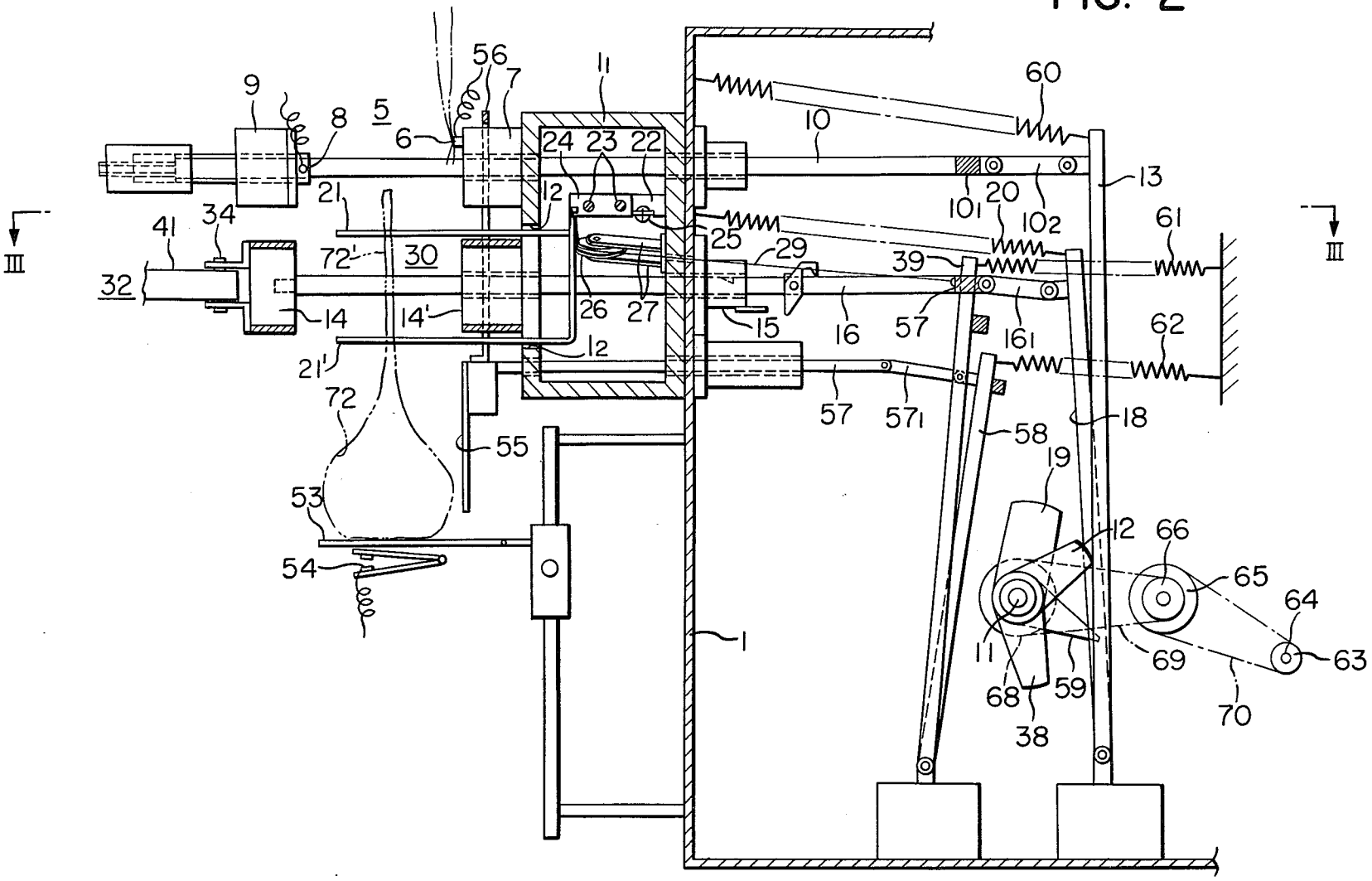
FIG. 2 is a schematical side elevational view of one of the embodiments of the present invention.

As shown in FIG. 2, heat-seal and fusion cutting device 5 is mounted to a bracket 1, having generally a hollow box-like shape, secured to apparatus frame 1 and comprises a stationary member 7 secured to the outer vertical surface of bracket 1, and a reciprocating member 9 arranged horizontally opposite to stationary member 7, stationary and reciprocating members 7, 9 being provided on their confronting surfaces with an electrical heating wire 6 for sealing and an electric heating wire 8 for fusion cutting, respectively, disposed up and down, respectively. Reciprocating member 9 is secured to one end of horizontal reciprocating rods 10 which loosely pass through correspondings openings formed in stationary member 7 and bracket $1_1$ near their side ends, the other ends of reciprocating rods 10 being fixedly connected together by a connecting rod $10_1$ within frame 1. Connecting rod $10_1$ is pivotally connected at about its mid-portion to a vertical swing lever 13 at its upper end portion through a linkage $10_2$, the lower end of swing lever 13 being pivotally connected to the base of frame 1, and swing lever 13 is adapted to be swung by the action of a cam 12 fixedly secured to a horizontal main driving shaft 11 adapted to be driven by an electric motor not shown through a reduction gear to be described later.

Figure 3:
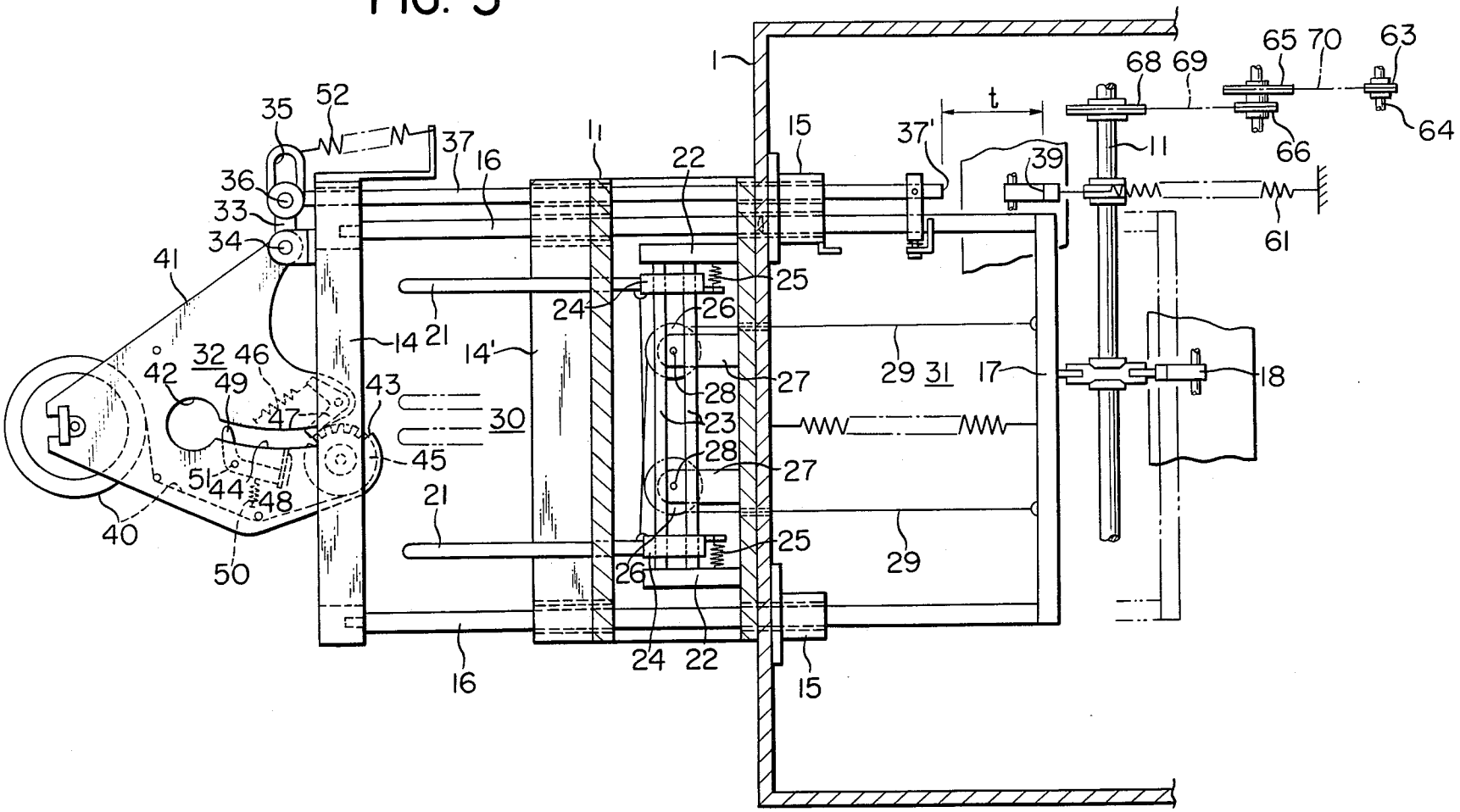
FIG. 3 is a schematical sectional plan view of FIG. 2 taken along the lines III—III in FIG. 2.

Secured to bracket $1_1$ directly below stationary member 7 at a distance is a stationary hollow frame 14' having generally a rectangular cross section, a reciprocating hollow frame 14 having a cross section similar to that of stationary hollow frame 14' being arranged horizontally so as to confront frame 14', stationary and reciprocating hollow frames 14, 14' thereby constituting squeeze mechanism 30. Reciprocating hollow frame 14 is secured to one end of a pair of horizontal reciprocating rods 16 which loosely pass through corresponding openings formed in stationary hollow frame 14' and bracket $1_1$ near their side ends, reciprocating rods 16 being further shiftably received within bearings 15 secured to the inside surface of the vertical wall of frame 1. The other ends of reciprocating rods 16 are fixedly connected together by a connecting rod 17 within frame 1 as shown in FIG. 3, connecting rod 17 being pivotally connected at about its mid-portion to a vertical swing lever 18 at its upper end portion through a linkage $16_1$, the lower end of swing lever 18 being pivotally connected to the base of frame 1, and swing lever 18 is adapted to be swung by the action of a cam 19 fixedly secured to main driving shaft 11 but angularly displaced from cam 12. The upper ends of swing levers 13 and 18 are connected to the inside of the vertical wall of frame 1 by springs 60 and 20, respectively, so that they are usually urged to cams 12 and 19, respectively.

Within the space formed between stationary sealer element 7 and stationary hollow frame 14' a pair of parallel horizontal bars 21, 21 is disposed so that the front end portions of the bars protrude forward beyond the outer edge of hollow frame 14' at right angles thereto, the rear end portion of the bars extending into the hollow space of bracket $1_1$ through the opening $1_2$ formed in its front vertical wall and being secured to sliders 24, 24 disposed within the space of bracket $1_1$, sliders 24, 24 being shiftably mounted on a pair of parallel horizontal guide bars 23 which are rigidly connected at their both ends to supports 22, 22 which are in turn rigidly secured to the surface of the inner vertical wall of bracket 11, whereby sliders 24, 24 are elastically connected to adjoining supports 22, 22 by coil springs 25, 25 disposed therebetween. Also within the space of bracket $1_1$ a pair of pulleys 26, 26 is disposed below guide bars 23, 23 substantially in a horizontal state, pivotally mounted to one end of supports 27 with pivots 28, 28, supports 27, 27 being fixedly secured at their other ends to the inner vertical wall of bracket $1_1$ in symmetry with respect to the center line between confronting reciprocating rods 16, 16. As shown in FIG. 3, wires 29 having their one ends rigidly secured to connecting rod 17 at a distance corresponding to the distance between pivots 28, 28 are loosely passed through corresponding openings formed in the vertical wall of frame 1 and the inner vertical wall of bracket $1_1$, their other end portions being reeved on pulleys 26, 26 to be rigidly connected at their ends to sliders 24, 24 such that wires 29, 29 intersect each other. Further, as shown in FIG. 2, an additional pair of horizontal bars 21', 21' each having a rear upstanding portion are rigidly connected at the upper ends of the rear upstanding portions to horizontal bars 21, 21 near their securing portions to sliders 24, whereby horizontal bars 21', 21' are elongated forwardly through opening $1_2$ and below stationary hollow frame 14' so as to be parallel with horizontal bars 21, 21. In this way, an interlocking mechanism 31 between squeeze mechanism 30, hollow frames 14, 14' and bars 21, 21' is constituted.

Reciprocating hollow frame 14 pivotally carries near its one end with a pin 34 an arm 33 of a taping device 32 as shown in FIG. 3, a pin 36 loosely received within a slot 35 formed in arm 33 being secured to one end of a horizontal slide bar 37 which loosely passes through corresponding openings formed in reciprocating hollow frame 14, stationary hollow frame 14', and bracket $1_1$, the other end portion of slide bar 37 being slidably supported by bearing 15 which also supports one of reciprocating rods 16, said other end of slide bar 37 also being disposed opposite to the upper end of a swing bar 39 with a predetermined gap t being left therebetween. Swing bar 39 has its lower end pivotally connected to the base of frame 1 and is adapted to be swung by the action of cam 38 fixedly secured to main driving shaft 11, angularly displaced from cams 12, 19.

Taping device 32 comprises a plate-like base frame 41 having generally a triangular shape, adapted to adequately rotatively carry a coil of adhesive tape 40 at its one apex spaced apart from the other apex where base frame 41 is pivotally connected to reciprocating hollow frame 14 by pin 34, base frame 41 being formed with a through hole 42 substantially centrally thereof which is in communication with, through an arcuate passage 44 formed therein, an entrance 43 for squeeze portion 72', entrance 42 being formed in one side of base frame 41 opposite to the coil of adhesive tape 40. In this case, central hole 42 is so located in base frame 41 that when base frame 41 swings about pin 34 from the position shown in FIG. 3 to that shown in FIG. 4 its center coincides with the center of the space enclosed by hollow frames 14, 14' and horizontal bars 21, 21, and arcuate passage 44 is so formed that it is centered at pin 34 and flows into entrance 43 at substantially the middle of the length of reciprocating hollow frame 14 in its outermost position as shown in FIG. 3. A gear 45 is rotatively mounted to main body 41 at the underside thereof near entrance 43 such that a portion of the teeth of gear 45 projects into arcuate passage 44, and a pressor 47 having generally a L-shaped form and pivotally connected to base frame 41 has its one, longer arm urged against the top ends of the teeth of gear 45 by the action of coil spring 46 disposed between the end of the other, shorter, arm and base frame 41, whereby the longer arm of pressor 47 cooperates with the teeth of gear 45 to close passage 44 at entrance portion 43 as shown in FIG. 5. Further, base frame 41 pivotally carries a tape cutter 49, having generally an L-shaped form, at its corner portion with a pin 51, a cutter 48 being secured to the end of one of the arms so that it is always kept outside arcuate passage 44 by the action of a coil spring 50 arranged between the arm and base frame 41, whereby the other arm $49_1$ protrudes into passage 44. Adhesive tape 40 from the coil of tape is guided underneath base frame 41 via suitable guide pins to gear 45, and then fed around the top ends of the teeth of gear 45 to be kept there by pressor 47 urged against the outer periphery of tape 40 by the action of coil spring 46. See FIG. 5. Base frame 41 is always kept in the position shown in FIG. 3 by the action of coil spring 52 disposed between the outer end portion of arm 33 integral with base frame 41 and a bracket secured to reciprocating hollow frame 14. Main driving shaft 11 suitably mounted by bearings horizontally in frame 1 has, as shown in FIG. 3, a sprocket 68 fixedly secured thereto which is adapted to be drivingly connected to a sprocket 66 secured to an intermediate shaft through an endless chain 69, a further sprocket 65 fixedly secured to the intermediate shaft being drivingly connected to a sprocket 63 fixedly secured to a driving shaft 64 through an endless chain 70, and driving shaft 64 being adapted to be driven by the electric motor not shown. In this case, the dimensions of sprockets 63, 65, 66 and 68 as well as of endless chains 70 and 69 are so selected that they cooperate with each other to drive main driving shaft 11 at a speed lower than that of the motor.

As shown in FIG. 2, squeezed packing support plate 53 is mounted to frame 1 horizontally by any known suitable means so that its height above the bottom of frame 1 is adjustable and it drops when a predetermined load is applied thereon. A detecting switch 54 for detection of the drop of support plate 53 is appropriately disposed directly below same. A reciprocating horizontal rod 57 received within corresponding openings formed in the outer and inner vertical walls of bracket $1_1$ secures at its forward end a vertical pusher board 55 for thrusting squeezed packing 72 on support plate 53 and a vertical separation board 56 for separation of synthetic film tube 4 possibly adhering to electrical heating wire 6. To this end, reciprocating rod 57 is pivotally connected to a swing lever 58 at its upper portion through a linkage $57_1$, lever 58 being adapted to be actuated by main driving shaft 11 through a cam 59 fixedly secured thereto and angularly displaced to the other cams, whereby swing lever 58 is always kept at its rearmost position by the action of a coil spring 62 disposed between it and frame 1.

Now the operation of the apparatus according to the present invention having the constitution described above will be explained as follows.

It is assumed that heat-seal and fusion cutting device 5, reciprocating and stationary hollow frames 14, 14', support frame 53, vertical pusher board 55, and vertical separation board 56, etc. are all in the positions shown in FIGS. 2 and 3, and that hopper 2 and hollow cylinder 3 shown in FIG. 1 are disposed vertically above heat-seal and fusion cutting device 5 on a line passing substantially through the center of the space enclosed by reciprocating and stationary hollow frames 14, 14' and horizontal parallel bars 21, 21. In this condition, after synthetic resin film tube 4 having its lower end previously sealed is thrust onto the outer periphery of hollow cylinder 3 in a bellows fashion as shown in FIG. 1, and provisions 71 are supplied into tube 4 through hopper 2, heat-seal and fusion cutting device 5 is operated such that reciprocating member 9 is moved towards stationary member 7 by the retraction of reciprocating rods 10 due to the swung of swing lever 13 owing to the action of cam 12 thereon because of the rotation of main driving shaft 11, whereby the heat-sealing of tube 4 above the level of provisions 71 and the subsequent severing of the heat-sealed part by heat-seal and fusion cutting device 5 are carried out in the known manner. Directly thereafter, reciprocating hollow frame 14 of squeezing mechanism 30 is moved towards stationary hollow frame 14' by the retraction of reciprocating rods 16 due to the swing of swing lever 18 owing to the action of cam 19 thereon. Simultaneously horizontal parallel bars 21 are forced to be moved towards each other due to the movement of sliders 24, 24 owing to their securement to the ends of wires 29 which are moved due to their securement at their other ends to connecting rod 17 through pulleys 26.

Thus, the relative positions between reciprocating and stationary hollow frames 14, 14' and horizontal parallel bars 21, 21' shown in FIGS. 2 and 3 are transformed into those shown in FIG. 4, resulting in the squeezing of synthetic resin film tube 4 at a portion directly below the heat sealed portion.

During the retarding movement of reciprocating hollow frame 14 due to the movement of reciprocating rods 16, 16, slide bar 37 is moved together with said frame 14, gap t between the end 37' of bar 37 and the upper end of swing bar 39 being eliminated. Therefore, when cam 38 rotates together with the rotation of main driving shaft 11, swing lever 39 is swung to push slide bar 37 leftwards as viewed in FIG. 3, resulting in the swing of base frame 41 of taping device 32 about pin 34 from the state shown in FIG. 3 to that shown in FIG. 4. Thus, while squeezed portion 72' is guided from entrance 43 to through hole 42 along arcuate passage 44, squeezed portion 72' is wound with adhesive tape 40 to be hermetically sealed. As to this tape winding process, a more detailed explanation will be given later.

In this state, squeezed packing 72 is held by squeezing mechanism 30 with squeezed portion 72' being pinched by the retracted reciprocating hollow frame 14 and stationary hollow frame 14' as well as the parallel horizontal bars 21, 21 now in close proximity, whereby squeezed packing 72 is suspended from squeezing mechanism 30.

Figure 4:
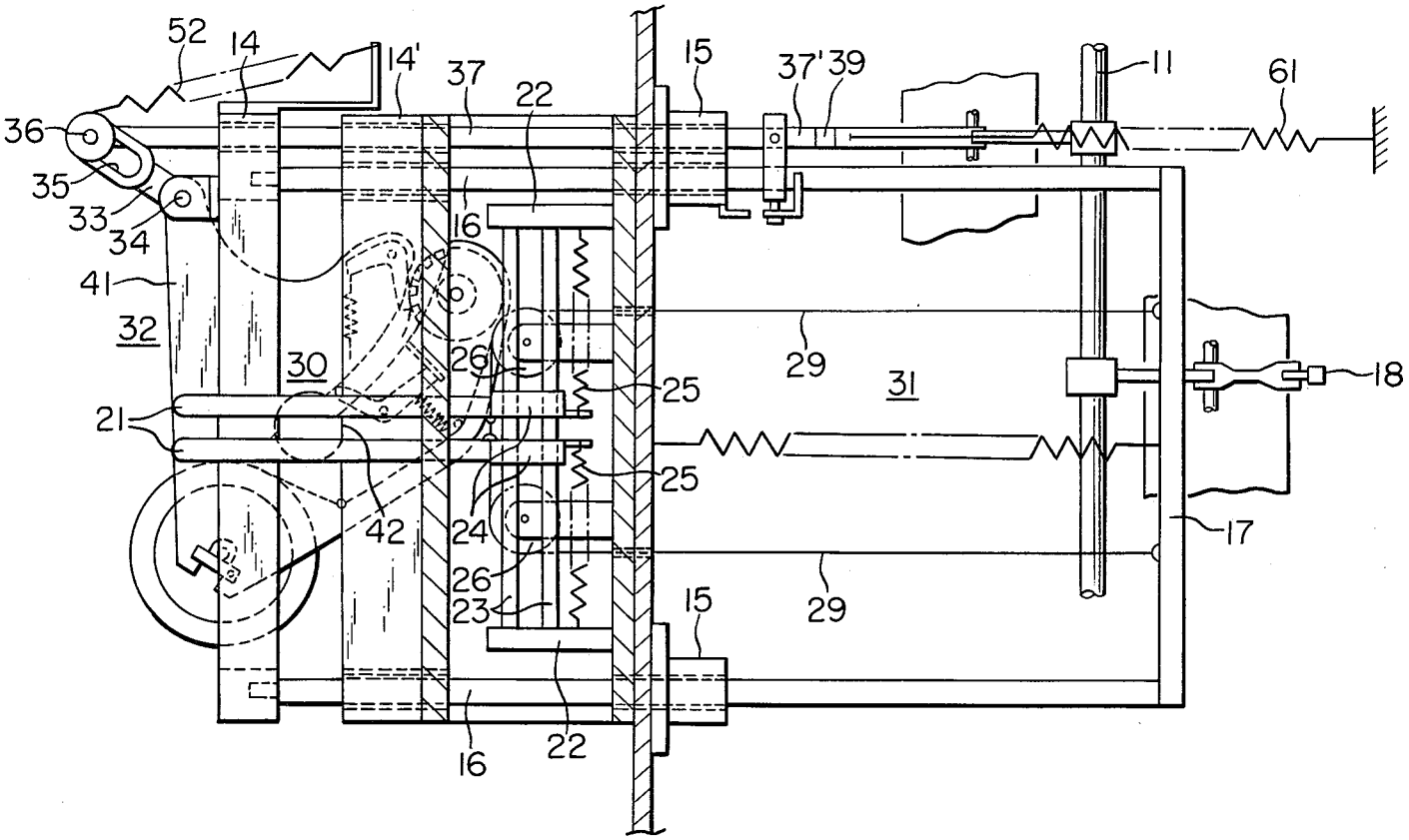
FIG. 4 is a similar view to FIG. 3, but showing the taping device shown in FIG. 3 in a different position.
Figure 5:
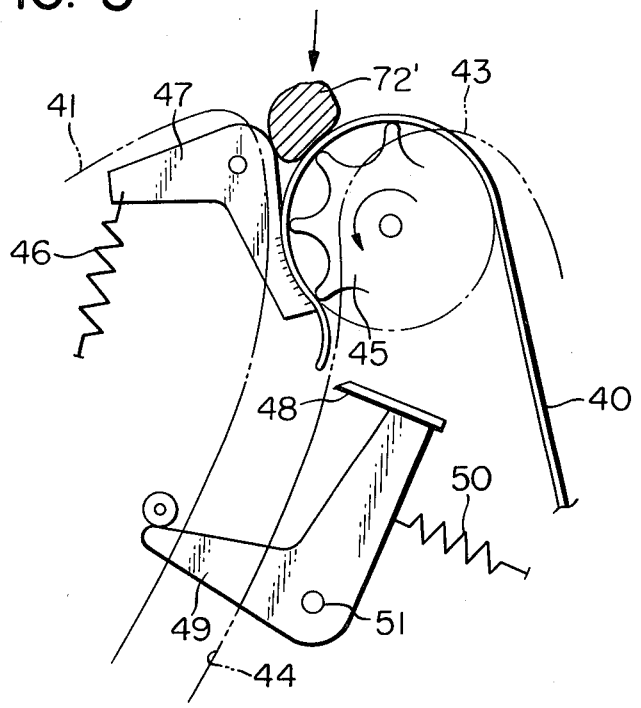
FIGS. 5 to 8 are partial plan views showing the operation of the taping device shown in FIGS. 3 and 4 in successive operational stages.

Upon returning from the position shown in FIG. 4 to that shown in FIG. 3, squeezed packing 72 lowers squeezed-packing support plate 53 downwards by its own weight to close switch 54, resulting in that pusher board 55 and vertical separation board 56 are caused to be moved to shift squeezed packing 72 leftwards as viewed in FIG. 2 and to separate the possible adhesion of tube 4 to electric heating wire 6 by the actuation of horizontal rod 57 due to the rotation of main driving shaft 11.

Thus, one operational cycle of the packing of provisions 71 in synthetic resin film tube 4 is completed, the cycle being renewed for the subsequent packing.

Now the process of taping squeezed portion 72' by the use of taping device 32 will be explained more fully in reference to FIGS. 5 to 8.

Figure 6:
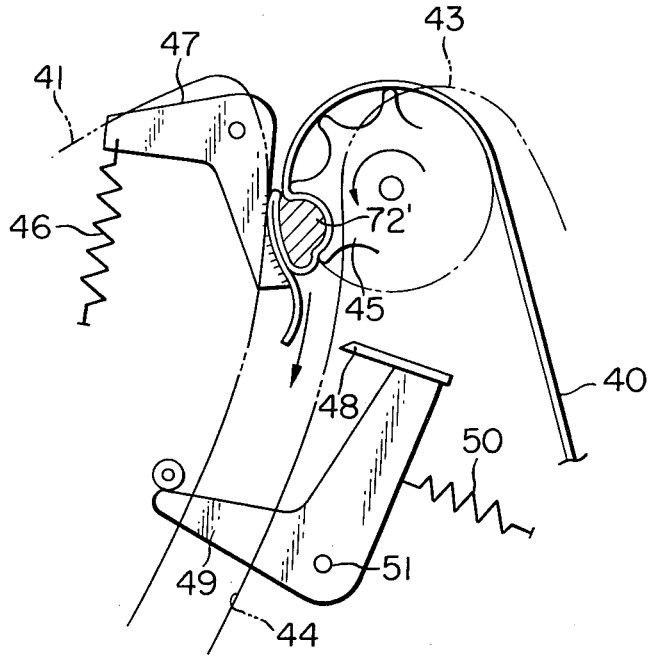
Figure 7:
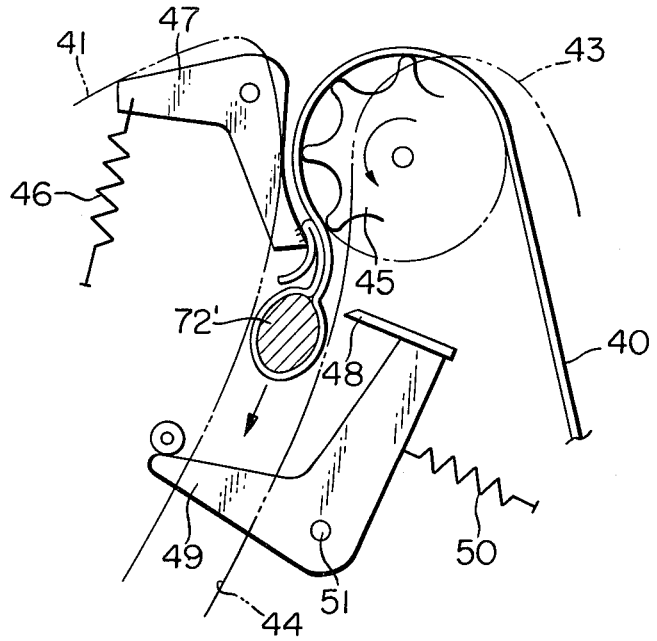
Figure 8:
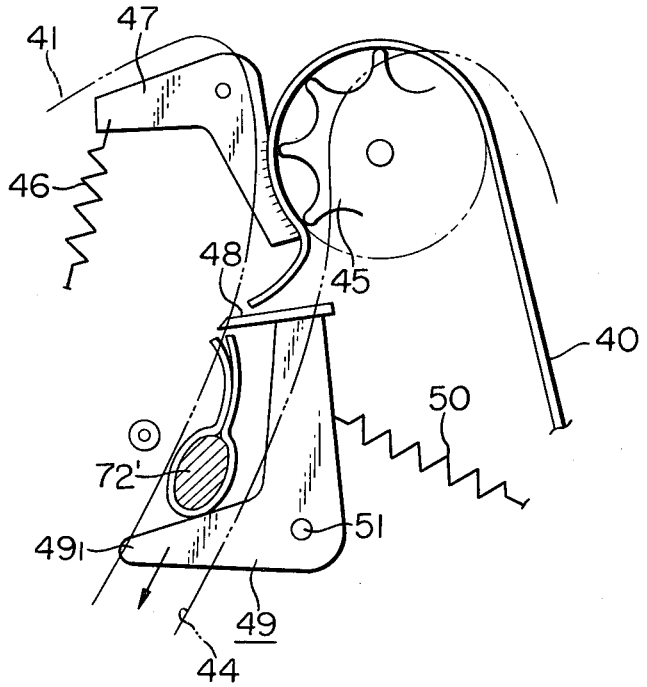

As shown in FIG. 5, in the course of swinging taping device 32 to its final position about pin 34 shown in FIG. 4, wherein the center of through hole 42 formed in base frame 41 is located at the center of the space enclosed by hollow frames 14, 14' and parallel bars 21, 21, squeezed portion 72' of squeezed packing 72 comes into contact with adhesive tape 40 at its adhesive surface at entrance 43 to arcuate passage 44 for squeezed portion 72'. In this case, it will be noticed that adhesive tape 40 has been previously adhered to the outer surface of the longer arm of pressor 47 in the preceeding taping cycle and that the adhesive surface of adhesive tape 40 is directed radially outwards relative to the periphery of gear 45. As taping device 32 swings further, as shown in FIG. 6, squeezed portion 72' is urged to be introduced between the longer arm of pressor 47 and gear 45 so that tape 40 is wound around substantially the whole periphery of squeezed portion 72' in association with the grooves between the teeth of gear 45. At this point, it will be appreciated that the free end of adhesive tape 40 is adhesively secured to the outer arcuate surface of the longer arm of pressor 47 as suggested by the hatches. Upon the further swing of taping device 32, as shown in FIG. 7, squeezed portion 72' is passed through the gap between pressor 47 and gear 45 to be entered into arcuate passage 44. In this case, the adhesive tape 40 which has been adhered to the arcuate outer surface of the longer arm of pressor 47 is progressively separated from pressor 47 to be adhesively secured to confronting tape 40 which has been pulled out around gear 45, whereby the confronting surfaces of adhesive tape 40 are both the adhesive surfaces. When squeezed portion 72' is moved further along arcuate passage 44, followed by the further swing of taping device 32, it comes into contact with actuating arm $49_1$ of tape cutter 49 so that arm $49_1$ is rotated counter-clockwise as viewed in FIG. 8 about pin 51 against the action of spring 50, resulting in the swing of cutter 48 about pin 51 so that adhesive tape 40 is cut by cutter 48. Thus, the taping operation for squeezed portion 72' of squeezed packing 72 is completed.

While a preferred embodiment of the present invention has been described and illustrated herein it will be understood that modifications may be made without departing from the spirit of the present invention.

What is claimed is:

1. A packing apparatus, in particular for provisions in a squeezed style package, comprising: an appartus frame; a hopper means arranged at the top of said apparatus frame to supply said provisions by gravity into a synthetic resin film tube with a sealed bottom; a heat-seal and cutting means for said tube arranged beneath said hopper means and comprising a stationary member secured to said frame with a heat-sealer and a reciprocating member arranged horizontally opposite thereto with a cutting device; a squeezing means arranged beneath said heat-seal and cutting means comprising two pairs of horizontal parallel bar means disposed at right angles to each other; means for moving said bar means towards and away from each other in a synchronized fashion, whereby said tube is allowed to be lowered through a space formed by said stationary and reciprocating members of said heat-seal and cutting means as well as a pair of said parallel bar means of said squeezing device when they are all moved apart; a taping means mounted near said squeezing means including means to wind an adhesive tape around the squeezed portion of said synthetic resin film; a driving means to activate said heat-seal and cutting means, and said taping means; said driving means comprising a main driving shaft, a plurality of cam means secured thereto, a number of link means each operatively connected to said heat-seal and cutting means, and one of said pairs of parallel bar means, each activated by one of said cam means; said taping means being connected to and activated by said one of said pairs of parallel bar means; a drive transmitting means connected between said one pair of parallel bar means and the other pair of said parallel bar means whereby the other of said pairs of parallel bar means is activated, via said transmitting means, by said one of said pairs of parallel bar means; said transmitting means comprising a pair of pulley means secured to said apparatus frame and wire means reeved on each of said pully means, each of said wire means having two ends, one of the ends of both wire means connected to one parallel bar means of said one of said pairs of parallel bar means, the other ends of each of both wires being independently connected to an associated one of the parallel bar means of said other of said pairs of parallel bar means, said wire means being shiftably mounted to said apparatus frame at right angles to said one of said pairs of parallel bar means.

2. The packing apparatus as defined in claim 1, wherein said cutting means is a fusion cutting means.

* * * * *